United States Patent [19]

Ford et al.

[11] Patent Number: 4,865,009

[45] Date of Patent: Sep. 12, 1989

[54] AIRGUN

[76] Inventors: John B. M. Ford, 17 Moor End Close, Eaton Bray, Dunstable, Bedfordshire LU6 2HP; Gerald V. Cardew, 12 Victoria Road, Accocks Green, Birmingham B27 7YA, both of United Kingdom

[21] Appl. No.: 90,585

[22] PCT Filed: Nov. 11, 1986

[86] PCT No.: PCT/GB86/00696

§ 371 Date: Jul. 13, 1987

§ 102(e) Date: Jul. 13, 1987

[87] PCT Pub. No.: WO87/03081

PCT Pub. Date: May 21, 1987

[30] Foreign Application Priority Data

Nov. 11, 1985 [GB] United Kingdom ..... 8527729

[51] Int. Cl.[4] ..... F41B 11/00

[52] U.S. Cl. ..... 124/76; 124/73; 124/70

[58] Field of Search ..... 124/70–74, 124/76, 56, 69

[56] References Cited

U.S. PATENT DOCUMENTS

| | | | |
|---|---|---|---|
| 645,932 | 3/1900 | Beck et al. | 124/72 |
| 2,594,240 | 4/1952 | Wells . | |
| 3,204,625 | 9/1965 | Shepherd . | |
| 4,572,152 | 2/1986 | Olofsson et al. | 124/69 |
| 4,616,622 | 10/1986 | Milliman | 124/76 |

FOREIGN PATENT DOCUMENTS

| | | |
|---|---|---|
| 220790 | 12/1956 | Australia . |
| 0076520 | 4/1983 | European Pat. Off. . |
| 3511379 | 2/1986 | Fed. Rep. of Germany . |

*Primary Examiner*—Randolph A. Reese
*Assistant Examiner*—Anthony Knight
*Attorney, Agent, or Firm*—Young & Thompson

[57] ABSTRACT

An airgun comprises a discharge chamber (3) for compressed air or gas. Compression of the air in the discharge tube is achieved by a pressurizing chamber (2) which contains pressurized gas or air. In one embodiment the discharge chamber (3) is filled by gas or air from the pressurizing chamber until a predetermined pressure within the discharge chamber is reached. A second embodiment provides liquefied gas in the pressurizing chamber that acts against a movable wall so as to ensure that the discharge chamber is at the liquefaction pressure.

11 Claims, 3 Drawing Sheets

AIRGUN

This invention relates to guns, and especially to guns that utilize gas or air to propel a pellet or other projectile.

Airguns that rely upon a compressed air cylinder to provide the propulsive discharge have been known for many years. These guns are popular because there is virtually no recoil and therefore no loss of concentration, which is often an effect on the user of gun recoil. However a problem with airguns operated by progressive discharge of a compressed air cylinder is in achieving consistency in the propulsive force which varies as the air cylinder discharges.

A typical prior art airgun comprises a rechargeable cylinder with a valve through which air is discharged to propel the pellet. The valve is of a type where the sealing surface is pushed into the air cylinder in response to the trigger to open the valve and the closure is effected by the pressure from within the air cylinder reseating the valve. The time for which the valve is open, and thus the level of gas discharge depends upon various factors but in particular the pressure within the air cylinder. In fact the pressure within the cylinder has several effects; with the high pressure of a newly filled cylinder the pressure within the cylinder resists the valve opening for longer, then while the valve is open relatively high pressure air discharges and finally the valve is urged closed earlier, with the overall result that a short relatively high pressure burst of air is discharged; with a nearly discharged cylinder in which the pressure is relatively low the valve opens earlier, the escaping air is of lower pressure and the valve closes later so that a longer relatively low pressure burst of air is discharged. Attempts have been made to balance the system by adjusting the valve area in order to provide greater equality between the masses of discharged air but these do not overcome the difference in the nature of the high and low pressure bursts and so, in terms of consistency of performance, the compressed air cylinder airgun is as yet not comparable with, for example, a mechanical spring gun. Thus the choice is either to use a mechanical pressurizing system for consistent projectile force but suffer recoil or use a compressed air cylinder gun and modify aim to compensate for the discharge characteristics.

Guns are available that operate on liquid gas cylinders, notably carbon dioxide, and of course for a given temperature the pressure within a liquid gas cylinder remains constant as long as there is some liquid still present. Therefore recoil free liquid gas guns, of similar structure to airguns, are available and these have (at constant temperature). the advantage of consistency by virtue of a liquid carbon dioxide cylinder replacing the compressed air cylinder. However these guns suffer from considerable temperature dependence there being a variation of as much as 100 psi (689 $kNm^{-2}$) in the liquefaction pressure between hot and cold days which gives inconsistency under varying temperature conditions. Also, in some countries these gasguns are classified as firearms, for example in the U.K. they are classified under Section 1 of the Firearms Act and therefore they have to be licensed.

The present invention is directed towards providing a gun of compressed gas cylinder type with consistent discharge characteristics. Within the context of this specification 'compressed gas' means gas that is pressurized but not liquified and 'pressurized' is used to imply both gas that is compressed and also gas that is liquified under pressure.

Accordingly the present invention provides a gun comprising a discharge chamber for holding compressed gas, means for discharging gas from the discharge chamber to propel a projectile, and means for compressing gas in the discharge chamber to a predetermined pressure between successive discharges, said means comprising a pressurized gas chamber adapted to hold gas at a pressure at least equal to the particular predetermined pressure.

In a first embodiment the means for compressing gas comprises a valve interconnecting the discharge chamber and the pressurized gas chamber, the valve being responsive to the pressure in the discharge chamber.

In another embodiment the means for pressurizing comprises a liquefied gas in the pressurized gas chamber that acts against a moveable piston disposed between the chambers.

In a preferred embodiment the invention provides a fluid operated gun comprising a discharge chamber for holding compressed gas, a block adapted to be held by a trigger, a shaft urged in a first direction by the block and a biasing means, the shaft being operatively connected to open a valve between the discharge chamber and a reservoir of pressurized gas and having an associated surface exposed to the pressure within the discharge chamber so that at a predetermined pressure the pressure exerted on the exposed surface urges the shaft in a second direction against the biasing means to close the valve.

The invention is now described by way of example with reference to the accompanying drawings in which.

Figure 1:
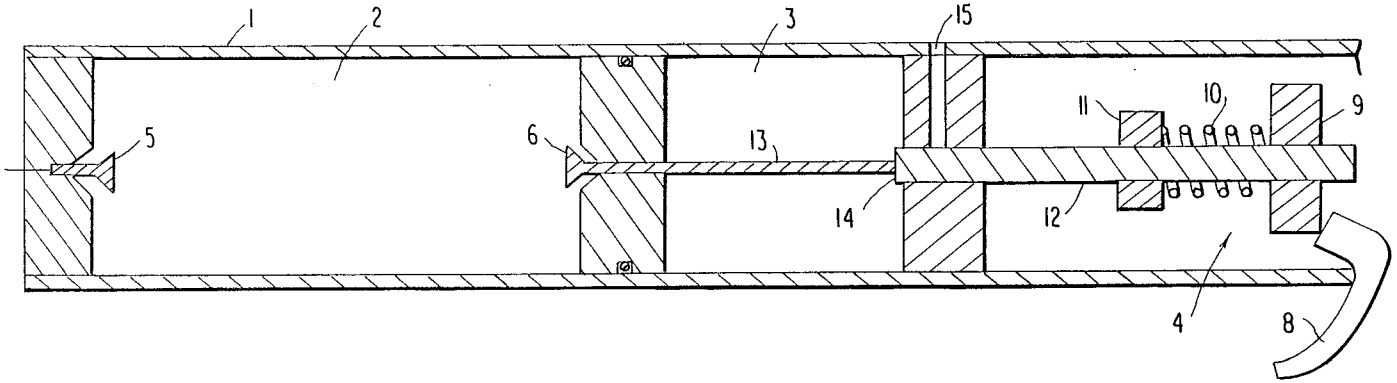
FIG. 1 is a schematic diagram of part of an airgun according to an embodiment of the invention.
Figure 2:
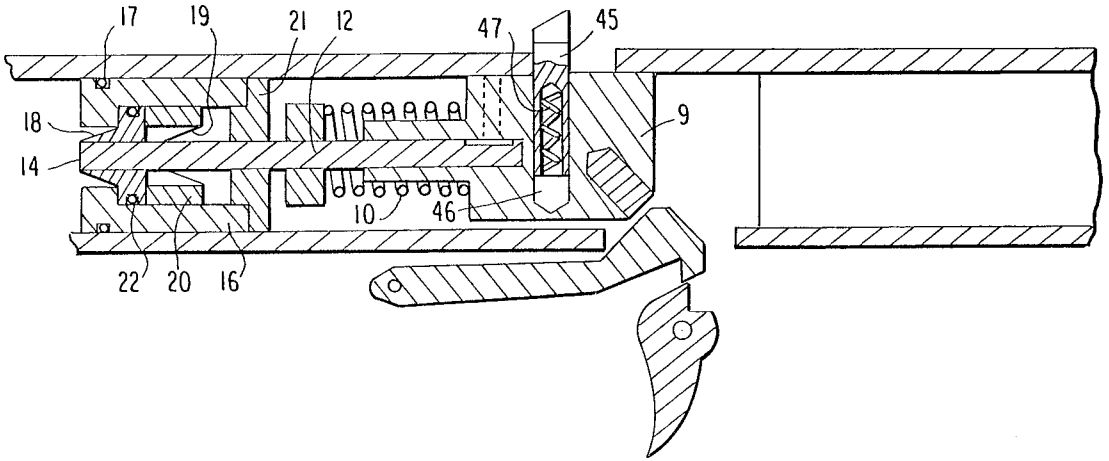
FIG. 2 is a schematic diagram of a release mechanism and discharge valve in an embodiment of the invention.
Figure 3:
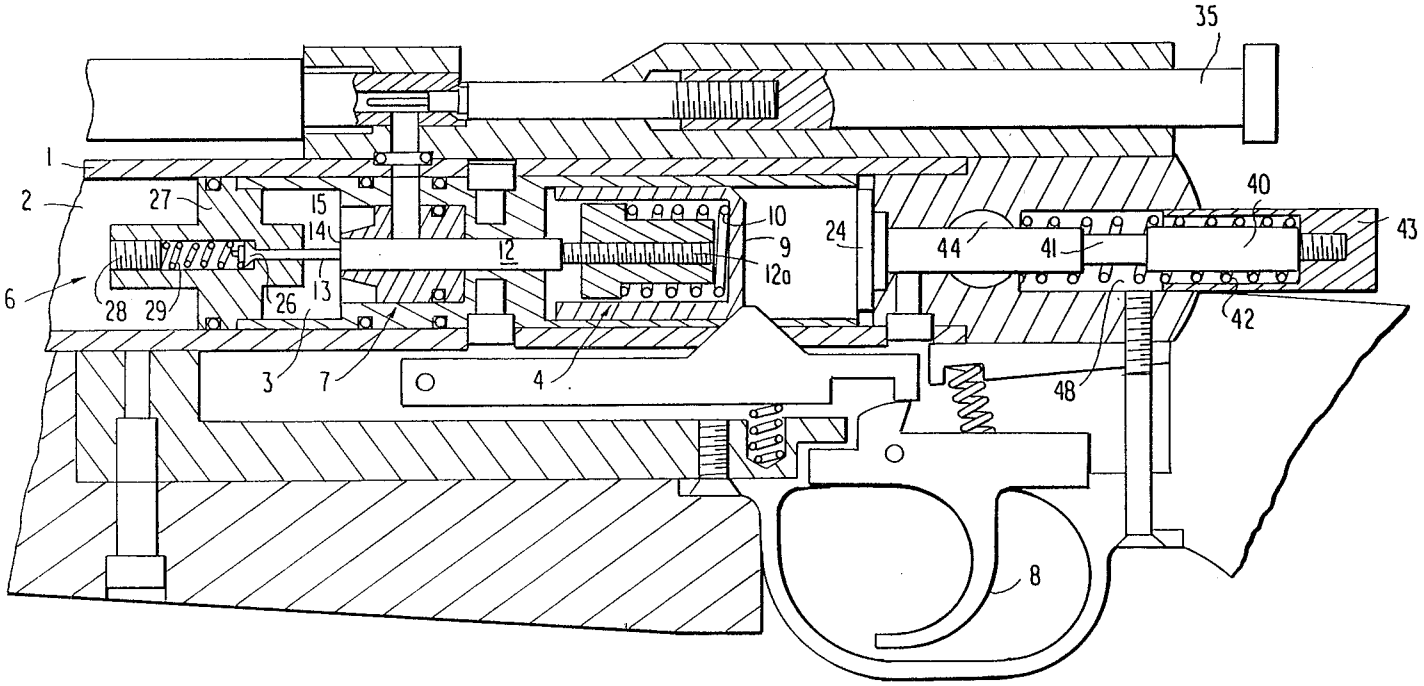
FIG. 3 is a detailed drawing of a preferred embodiment of the invention.

Referring firstly to FIG. 1 the principle of operation of a first embodiment is described. An outer barrel 1 encloses a first chamber 2, a second chamber 3 and a release mechanism and pressure regulator shown generally as 4. At the end of the chamber 2 remote from the release mechanism there is a valve 5 through which the chamber 2 is filled from a source of compressed gas, usually compressed air. The chamber 2 is filled to a pressure of about 3,000 psi (20684 $kNm^{-2}$). The end of chamber 2 adjacent chamber 3 is provided with a valve 6 which, when open, interconnects chambers 2 and 3. Chamber 3 has, at its opposite end to valve 6, a discharge valve 7 (shown in detail in FIG. 2). The release mechanism and pressure regulator 4 comprises a trigger 8, block 9, spring 10, retaining collar 11 and shaft 12 (or composite shaft 12*a*, 12 as shown in FIG. 3). One end of a second shaft 13 abuts shaft 12 at valve 7 and terminates at its other end in a conical valve member 26 that is part of valve 6.

To operate the airgun the chamber 2 is pressurized via valve 5 from an external source. This pressurizing stage is only required occasionally, perhaps after 60 shots. The conical valve piece 26 of valve 6 is held in the open position through shafts 12 and 13 which are urged in the direction of chamber 2 under the bias of spring 10 against the fixed collar 11. While shaft 12 bears against rod 13 there is an escape passage for air from chamber 2 into chamber 3 around the conical member of valve 6. As pressure in chamber 3 builds up it acts on the end 14 of rod 12 against the bias of spring 10 and once chamber 3 is at a predetermined pressure, which may be designed to be in the range of 200 to 1,000 psi (1379 to 6895 $kNm^{-2}$), the rod 12 is pushed to its maximum travel into the block 9 and in that position ceases to bear with its end 14 against the shaft 13. When rod 13 becomes free from the support of shaft 12 the pressure in chamber 2 pushes the conical valve member to close valve 6 so that no more air enters chamber 3. The result of this is that chamber 3 is pressurized to the predetermined pressure, which depends upon the strength of spring 10 and the surface area of shaft 12 facing into chamber 3.

In the arrangement shown in FIG. 1 the surface area and shape of the conical member of valve 6 is designed so that even at maximum pressure in chamber 3 the force on the shaft 13 transmitted to shaft 12 is insufficient to depress spring 10.

To release the gas from chamber 3 the trigger 8 is pulled which releases the stop on block 9 and the pressure in chamber 3 then forces the shaft 12 and the parts mounted on it backwards until block 9 abuts an end stop 24 (FIG. 3) at which point the end 14 of shaft 12 has retracted past a discharge port 15 and the air discharges from chamber 3 to propel a pellet in the known manner.

In FIG. 1 the block 9 is shown held by the trigger 8 for simplicity, of course this condition would be adopted immediately before firing and during reloading and charging of chamber 3 the block 9 would be held by other means. FIGS. 2 and 3 show mechanisms for resetting the valve 6 to charge chamber 3 and for holding the block 9 on a safety catch. In FIG. 2 a plunger 45 extends into a recess 46 in the block 9, the upper part of plunger 45 being urged upwardly by spring 47 to locate in a cam groove in the loading bolt (not shown) of the airgun. The bolt has three positions, a first most rearward position in which a pellet is located ready for the next shot, a second partly forward position in which the plunger 45 is urged forward along the cam groove taking block 9 with it so that valve 6 opens and the chamber 3 fills, and a third position fully forward which releases plunger 45 so that the block 9 moves rearwards to locate on the trigger stop. On firing, the block 9 and plunger move backwards together. In FIG. 3 the block 9 is urged forwards by a biased shaft 40 and is not connected to the bolt (which is shown by reference 35). The shaft 40 is provided with an outer casing 43 that slides in a recess 48 and a spring 42 is captured on the shaft to urge the shaft outwardly. When the outer casing 43 is pushed into the recess 48 the block 9 is pushed forwards and valve 6 opened to fill the chamber 3 the shaft 40 has a reduced diameter portion 41 that engages with a detent at location 44 to hold the shaft 40 and block 9 forwards. A safety catch release button (not shown) enables the detent to be released and the shaft 40 to move back to the position shown in FIG. 3, at which point the block 9 is held by the trigger ready for firing. The pellet loading mechanism operates in the known manner.

FIG. 2 also shows the valve 7 in schematic detail, the valve comprising a cylinder 16 secured to the barrel 1 and incorporating an o-ring seal 17. Within the bore of the cylinder 16 there are two bearings 18 and 19 for the shaft 12, spaced by a ring 20. The bearings 18 and 19 are held in position by a flanged end on the cylinder 16 and a flanged end plate 21. An o-ring seal 22 is provided around bearing 18. The bearings each have elongated lip portions that are relatively flexible and provide a seal in known manner with shaft 12. Although such lip seals are known the present embodiment modifies the known type by being fabricated from PTFE (polytetrafluorethylene) so that it can also function as low friction bearing. In FIG. 2 the end 14 of shaft 12 is shown in the position adopted when the chamber 3 is at the predetermined pressure. Upon trigger release the end 14 moves to the right as viewed to adopt a similar location with respect to seal bearing 19. The discharge port 15 (not shown) is located intermediate the seal bearing 18 and 19.

FIG. 3 shows an alternative structure for the seal bearings of valve 7. In this arrangement a single PTFE block comprises a lip seal around the end of shaft 12, the discharge port 15 extends upwardly from a central bore of the block through which the shaft 12 is threaded. When the shaft 12 moves backwards (to the right as viewed) upon depression of the trigger the end of the shaft 12 moves to the right (as viewed) of the opening of the discharge port 15. In this position there is no lip seal around the shaft 12, but the discharge is so rapid that there is little time for leakage to occur.

It has been found desirable to restrict the passage of air from chamber 2 into chamber 3. The restriction may be by way of a restricted orifice, such as through a hypodermic needle, but it has been found preferable to utilise a labyrinth path which may conveniently be provided along the thread of a screw. In FIG. 3 the preferred structure of valve 6 is illustrated, the valve comprising a valve body 27 having a bore within which the conical member 26 is situated at the end proximate chamber 3 and a screw 28 is inserted at the end proximate chamber 2. A spring 29 is captured between the screw 28 and conical member 26, and urges the conical member 26 closed once the rod 12 has ceased supporting the end of rod 13. The spring 29 is comparatively light and therefore provides negligible thrust on to rod 12 via rod 13.

It will be realized that the shaft 12 (or combined shafts 12 and 13) constitutes a floating shaft that can adopt four positions. The first position is when block 9 is fully forward and the valve 6 is open. In this position chamber 3 is filling, this process taking a few seconds. Once chamber 3 is fully pressurized the shaft 12 moves back, by for example 1 to 2 mm, to its second position and valve 6 closes. In this position shaft 12 is balanced between the pressure in chamber 3 and the bias of spring 10. A third position is adopted when the safety catch is released and block 9 moves back on to the trigger stop (again a movement of about 1 to 2 mm) ready for firing, and the fourth position is adopted after firing when the block 9 has moved back to the end stop, a movement of perhaps 7 mm.

A structure as described in connection with FIGS. 1 to 3 may be modified for use with liquified gas in chamber 2. In this case it would be desirable to incorporate a filter that prevents liquid from entering chamber 3. Such filters may consist of baffles or a microporous plug such as a sintered ceramic plug. Alternatively, or as well, the structure may be modified to utilize a disposable pressurized gas cylinder to refill or comprise the chamber 2.

Figure 4:
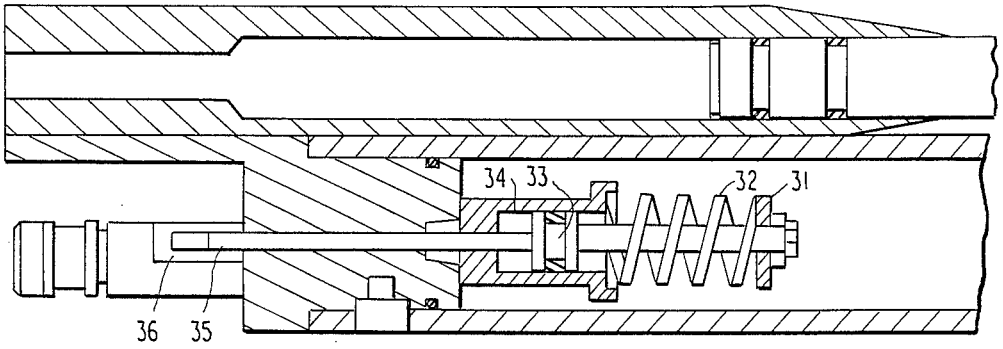
FIG. 4 illustrates a pressure gauge attachment.

FIG. 4 shows a pressure monitor that is preferably incorporated into the airgun in order to give the user an indication of the pressure remaining in the chamber 2, which is indicative of the number of shots remaining before a refill is required. The monitor comprises a pressure plate 31 on a supporting rod that is urged in the direction outwardly of chamber 2 under the influence of the gas pressure therein. A spring 32 provides resistance to the outward movement of the plate and rod. The rod is joined at its other end to a piston 33 which seals against a chamber wall 34 to form an end wall to chamber 2. Piston 33 has a further rod 35 extending from its other side, outside chamber 2, and this piston rod moves along a scale 36. When piston 33 and rod 35 are pushed outward to their maximum extent the chamber 2 is full, that is at 3,000 psi (20684 $kNm^{-2}$) pressure, and when retracted the chamber 2 is no longer at operating pressure. The scale 36 may be calibrated in terms of shots remaining.

Figure 5:
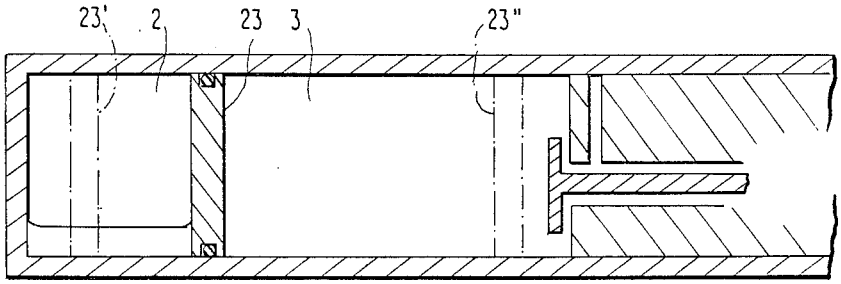
FIG. 5 shows a further embodiment of the invention.

A second embodiment of the invention is shown in FIG. 5. In this embodiment the structure of chamber 3 and the release mechanism may be of commonplace type with the exception that the wall 23 that seals the end of the chamber remote from the discharge valve is moveable. In a conventional airgun the walls of the compressed air chamber are of course all fixed. On the other side of wall 23 there is, as with the previous embodiment, another chamber 2 and it will be seen that instead of a dividing wall and valve as in FIG. 1, this embodiment has a moving wall, or piston, 23 and no communicating valve between the chambers. Within chamber 2 a liquefied gas is confined. If the liquefied gas is carbon dioxide, then at average ambient temperature the pressure exerted by the liquid in equilibrium with its vapour is 750 psi (5171 $kNm^{-2}$), and this force will be exerted on piston 23. On the other side of piston 23 the chamber 3 is initially filled with compressed air and as it fills and reaches that pressure the piston 23 moves leftward as viewed, reducing the volume of chamber 2, and gas in chamber 2 will condense to maintain the equilibrium. Once all the gas in chamber 2 has condensed the resistance to movement of piston 23 beyond the dotted outline position 23' increases sharply and at this point filling of chamber 3 is at a maximum. During subsequent use of the air from chamber 3, attended by a corresponding pressure drop, the pressure in chamber 3 becomes lower than that in chamber 2 and so more gas will vaporize and push the piston 23 to diminish the size of chamber 3 and thus restore the chamber to a pressure of 750 psi (5171 $kNm^{-2}$) or other pressure dependent on the liquefaction pressure for the gas used. In this way the liquefied gas provides a constant pressure bias so that substantially the entire content of chamber 3 may be discharged by the time piston 23 reaches the position 23'' with little pressure variation. An end stop or movement restrictor may delimit the maximum traverse of the piston (or moveable wall) and a mechanical bias may be provided to adjust the predetermined pressure by acting in addition to or against the gas bias.

With this latter embodiment the pressure exerted by the liquefied gas in chamber 2 is temperature dependent, although this variation is much less than the variation that occurs during discharge of a single cylinder airgun and can be measured so that for perfectionists a temperature calibration for sight adjustment may be made.

Although both embodiments have been described in connection with long arms it is envisaged that pistols or the like may also be constructed in a similar way.

I claim:

1. A fluid operated gun comprising a discharge chamber for holding compressed gas, a reservoir of pressurized gas communicating with the discharge chamber via a valve, a block adapted to be held in a firing position by a trigger, a shaft connected to the block and urged in a first direction by a biasing means, the shaft being operatively connected to open the valve between the discharge chamber and the reservoir of pressurized gas in response to positioning of the block in the firing position, the shaft having an associated surface exposed to the pressure within the discharge chamber so that at a predetermined pressure the pressure exerted on the exposed surface urges the shaft in a second direction against the biasing means to close the valve.

2. A gun according to claim 1, in which passage of gas from the reservoir to the discharge chamber is via a restricted orifice.

3. A gun according to claim 1, in which passage of gas from the reservoir to the discharge chamber is via a restricted labyrinthine passageway.

4. In a fluid operated gun comprising a discharge chamber for holding compressed gas, a reservoir of pressurized gas at higher pressure than the pressure in the discharge chamber communicating with the discharge chamber via a valve that is responsive to the pressure in the discharge chamber and a block adapted to be held by a trigger in a firing position; the improvement comprising a floating shaft extending from the block to the valve, the shaft having an enlarged diameter portion extending into the discharge chamber and sealing a discharge port, means for resiliently biasing the enlarged diameter portion inwardly of the discharge chamber when the block is in the firing position, the inward bias on the enlarged diameter portion of the shaft being arranged such that the shaft holds open the valve between the reservoir and discharge chamber until a predetermined pressure in the discharge chamber operating on the enlarged diameter portion urges the shaft outwardly of the discharge chamber against the resilient bias, and the enlarged diameter portion being arranged so that upon release of the block the enlarged portion of the shaft moves further outwardly of the discharge chamber and opens the discharge port to release gas from the discharge chamber to propel a projectile.

5. The improvement of claim 4, in which the shaft comprises two separable portions such that when pressure within the discharge chamber moves the enlarged diameter portion outwardly of the discharge chamber the portions of the shaft separate to disengage communication of the shaft with the valve.

6. The improvement of claim 4, in which passage of gas from the reservoir to the discharge chamber is via a restricted passageway comprising a hypodermic needle.

7. The improvement of claim 4, in which the passage of gas from the reservoir to the discharge chamber is via a restricted passageway comprising a screw thread.

8. The improvement of claim 4, in which the passage of gas from the reservoir to the discharge chamber is via a labyrinthine passageway.

9. A fluid operated gun having a discharge chamber for receiving compressed gas, the discharge chamber having a discharge port through which gas from the discharge chamber is released to propel a projectile, a release mechanism comprising a block and a trigger, the block being adapted to be held in a firing position until released by operation of the trigger to open the discharge port, a reservoir of pressurized gas for filing the discharge chamber, a valve interconnecting the reservoir and discharge chamber, and means controlling the valve so that the valve opens in response to movement of the block into the firing position and closes responsive to a predetermined pressure in the discharge chamber.

10. The gun of claim 9, in which the means controlling the valve comprises a mechanical linkage extending between and contacting both the valve and the release mechanism.

11. The gun of claim 9, in which passage of gas from the reservoir to the discharge chamber is via a restricted passageway comprising a hypodermic needle.

* * * * *